US005782618A

United States Patent [19]

Nishikawa et al.

[11] Patent Number: 5,782,618

[45] Date of Patent: Jul. 21, 1998

[54] ROTARY COMPRESSOR HAVING A ROUND CYLINDER BLOCK

[75] Inventors: Takahiro Nishikawa, Ohta; Kenzo Matsumoto, Gunma-ken; Takashi Sato, Kumagaya; Masaji Yamanaka, Tatebayashi, all of Japan

[73] Assignee: Sanyo Electric Co., Ltd., Osaka-fu, Japan

[21] Appl. No.: 718,946

[22] Filed: Sep. 24, 1996

[51] Int. Cl.[6] ..... F04B 35/04

[52] U.S. Cl. ..... 417/410.3; 418/63

[58] Field of Search ..... 417/410.1, 410.3, 417/902; 418/63

[56] References Cited

U.S. PATENT DOCUMENTS

| | | | |
|---|---|---|---|
| 4,780,067 | 10/1988 | Suzuki et al. | 417/410.3 |
| 4,915,554 | 4/1990 | Serizawa | 418/94 |

FOREIGN PATENT DOCUMENTS

| | | | |
|---|---|---|---|
| 58-2111585 | 9/1983 | Japan | 417/410.3 |
| 58202392 | 3/1984 | Japan . | |
| 59108882 | 10/1984 | Japan . | |
| 59145391 | 12/1984 | Japan . | |
| 60-1385 | 1/1985 | Japan | 417/410.3 |
| 04086393 | 7/1992 | Japan . | |

*Primary Examiner*—Charles G. Freay

*Attorney, Agent, or Firm*—Weingarten, Schurgin, Gagnebin & Hayes LLP

[57] ABSTRACT

There is provided a rotary compressor comprising an electric driving element and a rotary compression element in a hermetically sealed casing and constituted by setting a round cylinder block of the rotary compression element between a main bearing and an auxiliary bearing both of which support a shaft of the electric driving element and joining and securing at least two joining ends of the cylinder block to the inner periphery of the hermetically sealed casing; in which the thickness between the outermost ends of the joining ends of the cylinder block is set to 45 to 85% of the maximum thickness of the cylinder block in the axis direction. The rotary compressor of the present invention makes it possible to greatly reduce the air column resonance in the hermetically sealed casing due to pressure pulsation of discharged gas and the vibration due to pressure pulsation in the cylinder block of the rotary compression element and moreover reduce noises during operation.

7 Claims, 5 Drawing Sheets

ROTARY COMPRESSOR HAVING A ROUND CYLINDER BLOCK

BACKGROUND OF THE INVENTION

1. Field of the Invention

The present invention relates to a rotary compressor to be mounted on an air conditioner or refrigerator, particularly to a rotary compressor capable of greatly reducing the air column resonance in a hermetically sealed casing due to pressure pulsation of discharged gas and the vibration due to pressure pulsation in a cylinder block of a rotary compression element and reducing noises during operation by improving the joining structure of a round cylinder block of the rotary compression element in the hermetically sealed casing and moreover improving the space formed between an electric driving element and the rotary compression element.

2. Background Art

As shown in FIG. 6, for example, this type of the conventional rotary compressor comprises an electric driving element 2 and a rotary compression element 4 having a cylinder block 5 driven by a shaft 3 of the electric driving element 2 in the bottom of a hermetically sealed casing 1 storing refrigerator oil O in its bottom. Said cylinder block 5 is set between a main bearing 6 and an auxiliary bearing 7 both of which support the shaft 3 of the electric driving element 2 through a cup 8 and moreover, top end face 5*a* and bottom end face 5*b* of the cylinder block 5 comprising a joining end are jointed with inner periphery 1*a* of the hermetically sealed casing 1 and secured. Moreover in the above structure, a space 10 is formed between the top of the joining end of the facing cylinder block 5 and an end face 2*a* of the electric driving element 2. In this case, this type of the compressor is constituted by using the anchor type shown in FIG. 7 as the shape of the cylinder block 5.

In the case of the above rotary compressor having the conventional structure, however, it is difficult to reduce the high-frequency vibration of the hermetically sealed casing 1 because the joint area with the hermetically sealed casing 1 is small when using the anchor-type cylinder block 5 as the rotary compression element 4.

However, when using a round cylinder block 5 as shown in FIGS. 8 and 9, the reflectance of vibration noises has a value close to 100% because most of the whole interface with the space 10 must be formed with a rigid wall though the joint area with the hermetically sealed casing 1 increases. Therefore, it is difficult to reduce the air column resonance in the hermetically sealed casing 1 due to pressure pulsation of discharged gas and the vibration due to pressure pulsation in the cylinder block 5 and thereby, it is impossible to reduce the noise level of a low frequency range.

FIG. 10 shows measurement results of resonance frequencies at air-gap neighborhood 10*a*, cup discharge hole neighborhood 10*b*, and stator core neighborhood 10*c* when employing the round cylinder block 5. From FIG. 10, it is found that there are many resonance modes and the sound-pressure absolute value is also high because the whole interface with the space 10 is formed with a rigid wall.

It is an object of the present invention to provide the above-described rotary compressor capable of greatly reducing the air column resonance in a hermetically sealed casing due to pressure pulsation of discharged gas and the vibration due to pressure pulsation in a cylinder block of a rotary compression element.

SUMMARY OF THE INVENTION

To solve the above problem, the present invention uses a rotary compressor comprising an electric driving element and a rotary compression element having a round cylinder block and to be driven by the electric driving element in the bottom of a hermetically sealed casing storing refrigerator oil in its bottom and constituted by setting the round cylinder block of the rotary compression element between a main bearing and an auxiliary bearing for supporting the shaft of the electric driving element and joining and securing at least two joining ends of the cylinder block to the inner periphery of the hermetically sealed casing, in which the thickness between outermost ends of the joining ends of the cylinder block is set to 45 to 85% of the maximum thickness of the cylinder block in the axis direction.

Moreover, the present invention provides a rotary compressor constituted so as to form a space between an end face comprising the joining end of the facing cylinder block and an end face of the electric driving element and fill at least a part of the space with a sound absorbing material to form an interface in the space further in the above structure.

Furthermore, the present invention provides a rotary compressor constituted so as to cover 50% or more of the area of an end face comprising the joining end of the cylinder block with a sound absorbing material further in the above structure.

For the present invention, the thickness between the outermost ends of the joining ends of the round cylinder block must be set to 45 to 85% of the maximum thickness of a cylinder block in the axis direction. When the rate is larger than 85%, the possibility for the whole top end face of the cylinder block to serve as a rigid wall surface increases and it is impossible to reduce low-frequency noises. However, when the rate is less than 45%, the change of the cylinder-block inside diameter or vane slot width increases due to shrinkage fitting to or tack welding of hermetically sealed casing 1. This not only greatly influences the performance of a compressor but also prevents high-frequency noises from reducing because the vibration of the hermetically sealed casing cannot completely be prevented.

Moreover, by setting the thickness of the cylinder block as described above, the cylinder block is decreased in weight and it is possible to cut the cost and decrease the total weight of the compressor.

Furthermore, because the present invention is constituted so as to form another interface in the space between the end face comprising the joining end of the facing cylinder block and the end face of the electric driving element and fill the space with a sound absorbing material, the resonance frequency in the space is shifted to higher level in accordance with the sound absorbing coefficient of the sound absorbing material and low-frequency noises are reduced. Furthermore, because a round cylinder block is used, the joint area with the hermetically sealed casing of the cylinder block serving as an interface of a space increases, excitation of high-frequency vibration due to pressure pulsation in the cylinder block is minimized, noise levels from low- to high-frequency ranges can be lowered, and thereby noises can be reduced during operation.

Conventionally used refrigerator oil is suitable as the sound absorbing material. That is, it is preferable to fill refrigerator oil until the oil reaches the space between the end face comprising the joining end of the facing cylinder block and the end face of the electric driving element. Or, when it is impossible to change the quantities of refrigerator oil because of output, it is also possible to form another interface made of refrigerator oil in the space by adjusting the thickness between the outermost ends of the joining ends of the round cylinder block until refrigerator oil reaches the space in a range of 45 to 85% of the maximum thickness of the cylinder block in the axis direction.

Furthermore, it is preferable to cover 50% or more of the area of the end face comprising the joining end of the cylinder block with refrigerator oil. Thereby, it is estimated that the sound pressure level of the space is lowered, the resonance frequency is shifted to higher level, and the sound level of low frequencies is lowered.

DETAILED DESCRIPTION OF THE PREFERRED EMBODIMENTS

Figure 2:
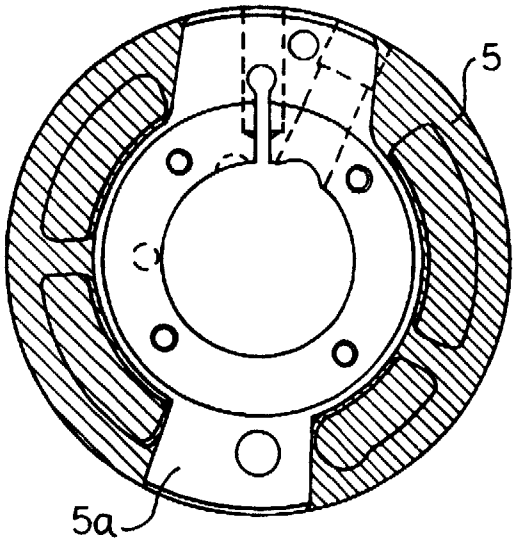
FIG. 2 is a top view showing a cylinder block of a rotary compressor of the present invention covered with a sound absorbing material by oblique lines.

The present invention is described below by referring to the accompanying drawings. However, the present invention is not restricted to these drawings.

An embodiment of the present invention is described below in detail by referring to the drawings shown in FIGS. 1 to 5.

Figure 8:
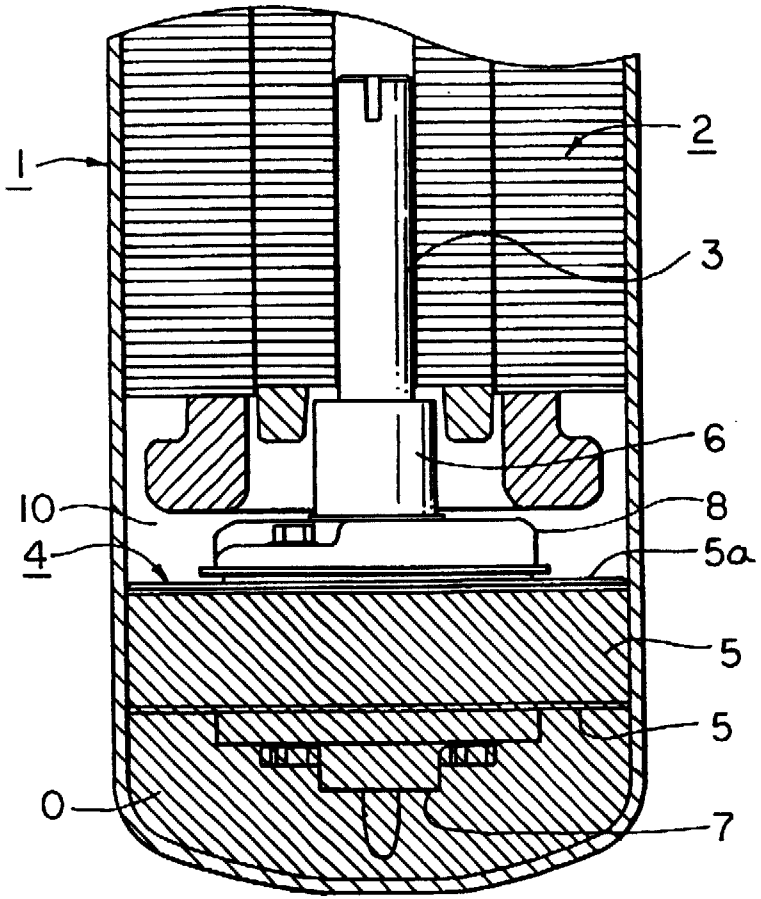
FIG. 8 PRIOR ART
FIG. 8 is a sectional view of an essential portion showing another conventional rotary compressor.
Figure 9:
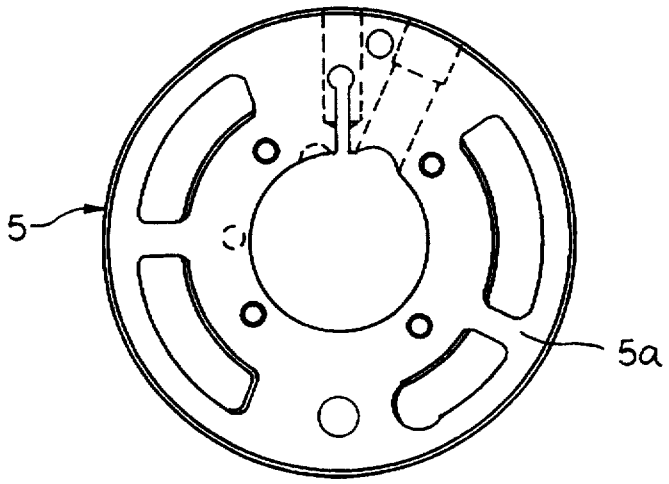
FIG. 9 PRIOR ART
FIG. 9 is a top view of a conventional round cylinder block.

A rotary compressor of the present invention has a general structure almost the same as that of a conventional rotary compressor using a round cylinder block as shown in FIG. 8 and 9.

Figure 1:
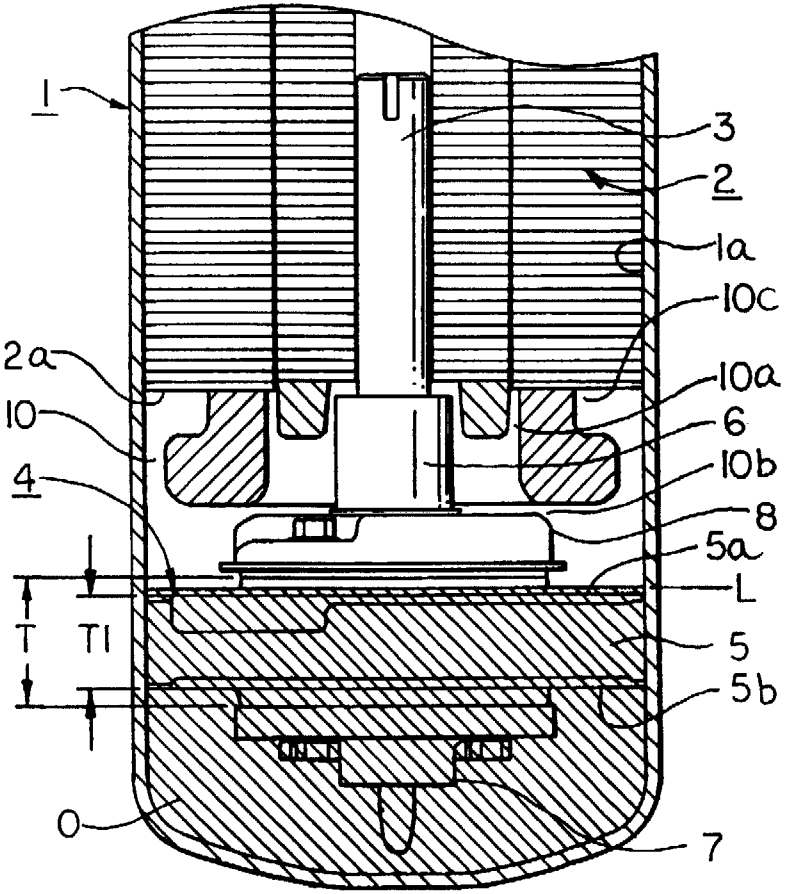
FIG. 1 is a sectional view of an essential portion showing an embodiment of a rotary compressor of the present invention.
Figure 3:
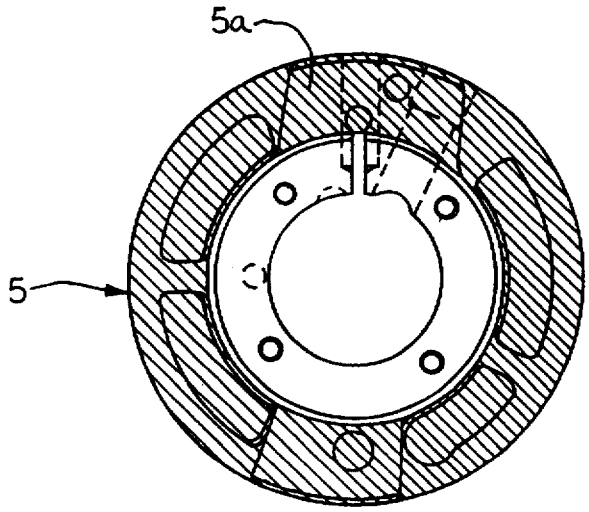
FIG. 3 is a top view showing the surface of the cylinder block in FIG. 2 covered with refrigerator oil by oblique lines.

That is, as shown in FIG. 1, the rotary compressor of the present invention comprises an electric driving element 2 and a rotary compression element 4 having a round cylinder block 5 driven by a shaft 3 of the electric driving element 2 at the bottom of a hermetically sealed casing 1 for storing refrigerator oil O in its bottom. Said cylinder block 5 is set between a main bearing 6 and an auxiliary bearing 7 both of which support the shaft 3 of the electric driving element 2 through cup 8 and moreover, top end face 5*a* and bottom end face 5*b* comprising the joining end to the inner periphery of the cylinder block 5 are joined and secured to inner periphery 1*a* of the hermetically sealed casing 1. Moreover in the above structure, a space 10 is formed between top end face 5*a* of the facing cylinder block 5 and end face 2*a* of the electric driving element 2.

Said cylinder block 5 is round as shown in FIG. 2 and top end face 5*a* of the joining end of the cylinder block 5 facing the electric driving element is used as one of the interfaces of the space 10. Moreover, thickness T1 between outermost ends of the joining ends of the cylinder block shown in FIG. 1 is set to 45 to 85% of the maximum thickness of the cylinder block in the axis direction.

Furthermore, as shown by oblique lines in FIG. 2, the level of oil surface L is raised so that 50% or more of the area of top end face 5*a* is dipped in refrigerator oil O and refrigerator oil O is used as a sound absorbing material for filling a part of the space 10.

The area of top end face 5*a* of the cylinder block 5 to be dipped in refrigerator oil O is set to 50% or more because of the following reasons. That is, the sound field characteristic in a closed space is generally calculated by providing a vertically-incoming acoustic impedance when a sound absorbing material is present in a part of the space. However, speed increases at the boundary between the interface of the sound absorbing material and the interface made of other rigid wall and the sound pressure at a resonance frequency tends to rise. Moreover, when comparing the sound pressure of the interface of the sound absorbing material with that of the interface made of the rigid wall, the interface of the sound absorbing material tends to have a very low sound pressure.

Figure 4:
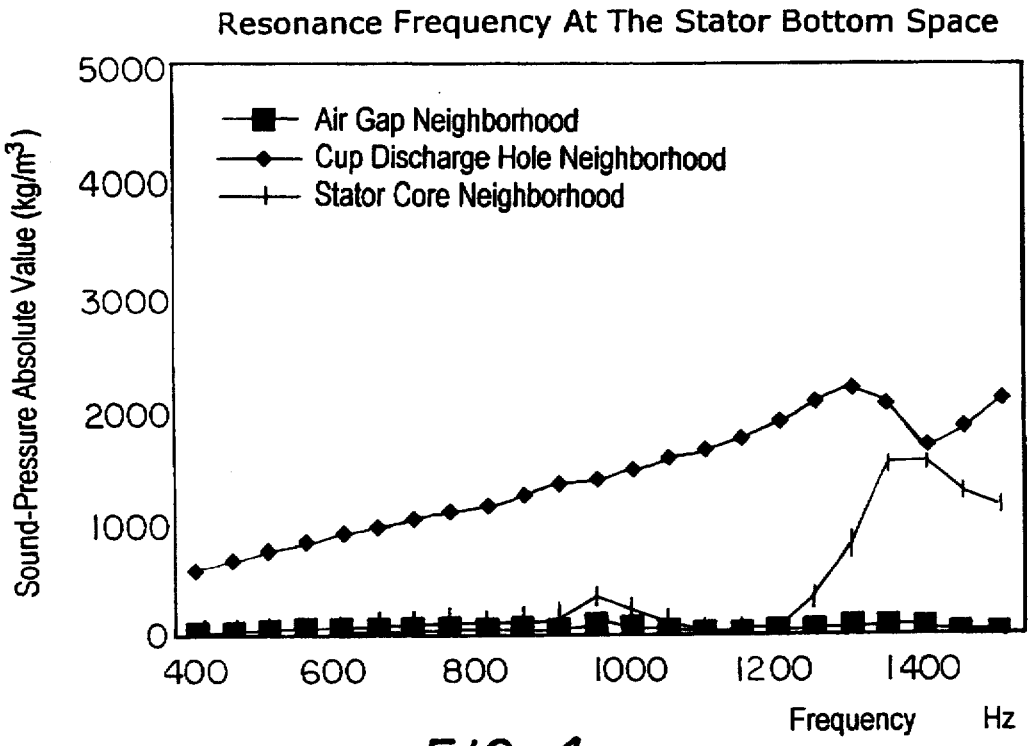
FIG. 4 is an illustration showing measurement results of resonance frequencies of a space when using a round cylinder block of the present invention.
Figure 10:
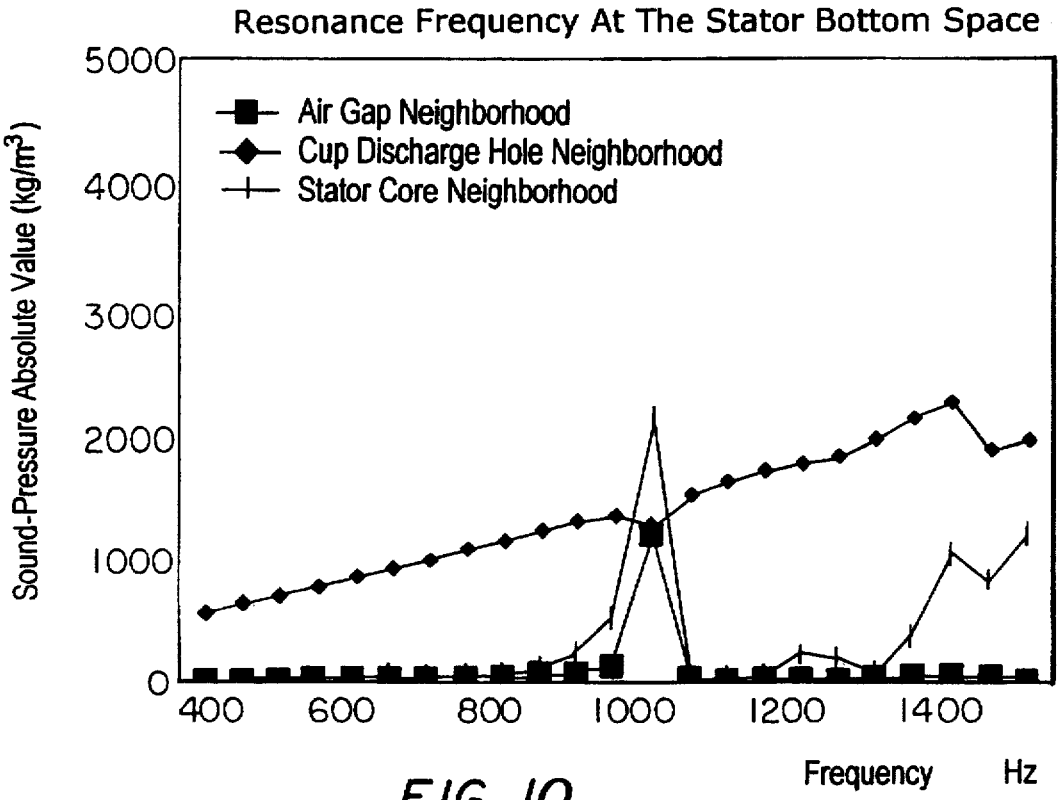
FIG. 10 PRIOR ART
FIG. 10 is an illustration showing measurement results of resonance frequencies of a space when using a conventional round cylinder block.

FIG. 4 shows measurement results of resonance frequencies at the air gap neighborhood, cup discharge hole neighborhood, and stator core neighborhood of space 10 when applying the technical idea of the present invention to new-type round cylinder block 5. From FIG. 4, it is found that the resonance modes are reduced and moreover, the sound-pressure absolute value is reduced compared to the case in which the whole interface of space 10 is formed with a rigid wall when using conventional round cylinder block 5 shown in FIG. 10.

Figure 5:
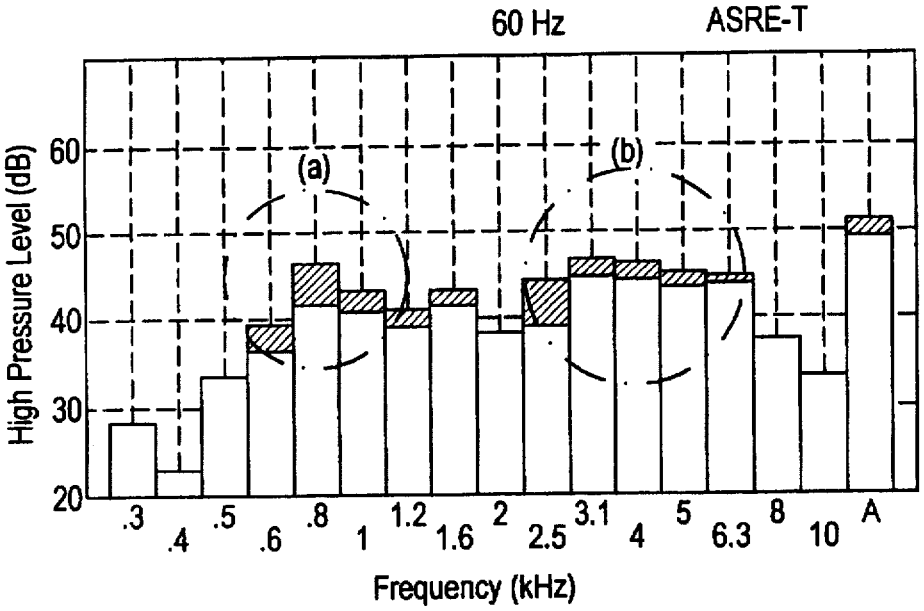
FIG. 5 is an illustration comparing noise measurement results of a rotary compressor of the present invention and those of a conventional rotary compressor.
Figure 6:
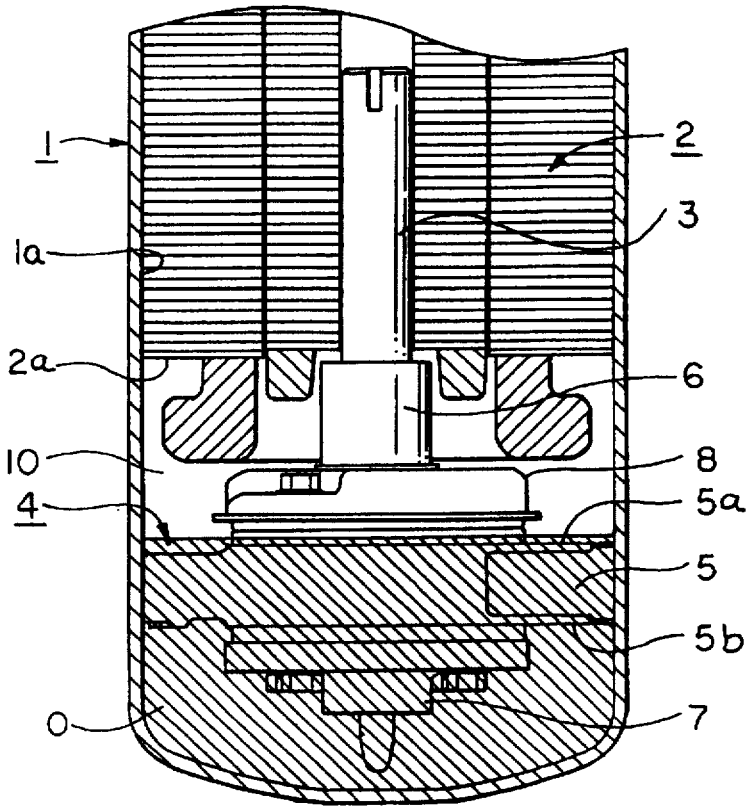
FIG. 6 PRIOR ART
FIG. 6 is a sectional view of an essential portion showing a conventional rotary compressor.
Figure 7:
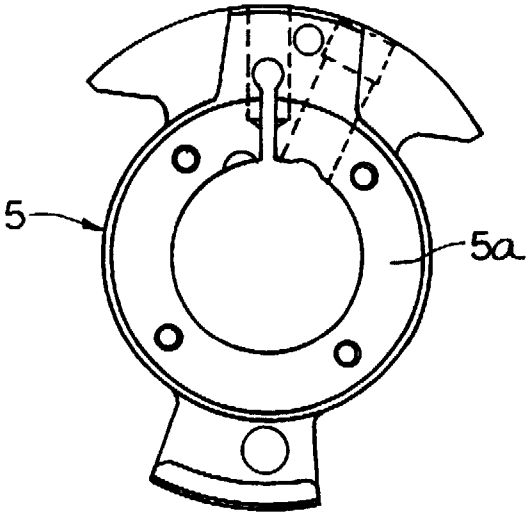
FIG. 7 PRIOR ART
FIG. 7 is a top view of a conventional anchor-type cylinder block.

Moreover, FIG. 5 compares noises of a rotary compressor of the present invention with those of a conventional rotary compressor, in which the low-frequency range in dotted-line circle (a) shows the effect of dipping top end face 5*a* of cylinder block 5 in refrigerator oil O and the high-frequency range in dotted-line, circle (b) shows the effect of using new-type round cylinder block 5 preferably used for the present invention. Thereby, the sound pressure level (dB) is lowered by approx. 3 dB by the characteristic of frequency (Hz) A.

What is claimed is:

1. A rotary compressor comprising an electric driving element and a rotary compression element having a round cylinder block and driven by the electric driving element in the bottom of a hermetically sealed casing for storing refrigerator oil in its bottom and constituted by setting the cylinder block of said rotary compression element between a main bearing and an auxiliary bearing both of which support the shaft of said electric driving element and joining and securing at least a first and second end faces of said cylinder block to the inner periphery of said hermetically sealed casing; wherein the thickness between the outermost ends of the first and second end faces of said cylinder block is set to 45 to 85% of the maximum thickness of said cylinder block in the axis direction.

2. The rotary compressor according to claim 1, wherein a space is formed between the first end face of said cylinder block and an end face of said electric driving element and at least part of the space is filled with a sound absorbing material so as to further form an interface in said space.

3. The rotary compressor according to claim 1 wherein 50% or more of the area of the first end face of said cylinder block is covered with a sound absorbing material.

4. The rotary compressor according to claim 2, wherein said sound absorbing material is refrigerator oil.

5. The rotary compressor according to claim 2, wherein 50% or more of the area of the first end face of said cylinder block is covered with a sound absorbing material.

6. The rotary compressor according to claim 3, wherein said sound absorbing material is refrigerator oil.

7. The rotary compressor according to claim 5, wherein said sound absorbing material is refrigerator oil.

* * * * *